US006851238B2

(12) United States Patent
Rebman

(10) Patent No.: US 6,851,238 B2
(45) Date of Patent: Feb. 8, 2005

(54) CEILING GRID SYSTEM AND METHOD OF ASSEMBLING THE SAME

(76) Inventor: Robert J. Rebman, 140 Twin Harbor Dr., Winneconne, WI (US) 54986

( * ) Notice: Subject to any disclaimer, the term of this patent is extended or adjusted under 35 U.S.C. 154(b) by 0 days.

(21) Appl. No.: 10/097,774

(22) Filed: Mar. 14, 2002

(65) Prior Publication Data

US 2003/0172609 A1 Sep. 18, 2003

(51) Int. Cl.[7] ..... E04B 2/00; E04B 5/00; E04B 9/00

(52) U.S. Cl. ..... 52/506.07; 52/664; 52/22

(58) Field of Search ..... 52/506.07, 664, 52/22, 506.01, 506.06, 506.08, 506.09, 506.1, 665

(56) References Cited

U.S. PATENT DOCUMENTS

| | | | | |
|---|---|---|---|---|
| 2,500,377 A | | 3/1950 | Poupitch | |
| 3,000,474 A | | 9/1961 | Friedman et al. | |
| 3,263,388 A | | 8/1966 | Bogert | |
| 3,270,479 A | * | 9/1966 | Weinar | 52/667 |
| 3,319,389 A | | 5/1967 | Levine | |
| 3,355,206 A | | 11/1967 | Valsvik | |
| 3,356,402 A | | 12/1967 | Smith | |
| 3,367,695 A | * | 2/1968 | Haertel et al. | 403/219 |
| 3,378,976 A | * | 4/1968 | Meredith, Jr. | 52/506.07 |
| 3,512,819 A | | 5/1970 | Morgan et al. | |
| 3,594,970 A | | 7/1971 | MacGrath et al. | |
| 3,683,101 A | | 8/1972 | Liberman | |
| 3,844,086 A | | 10/1974 | Radtke | |
| 4,034,531 A | | 7/1977 | Balinski | |
| 4,106,878 A | * | 8/1978 | Jones | 403/28 |
| 4,115,970 A | | 9/1978 | Weinar | |
| 4,128,978 A | | 12/1978 | Beynon | |
| 4,263,763 A | | 4/1981 | Bouwens | |
| 4,452,021 A | | 6/1984 | Anderson | |
| 4,485,605 A | | 12/1984 | LaLonde | |
| 4,499,697 A | * | 2/1985 | LaLonde | 52/98 |
| 4,548,013 A | | 10/1985 | Reina Briceno | |
| 4,569,175 A | | 2/1986 | Abciuk | |
| 4,580,387 A | | 4/1986 | Rogers | |
| 4,586,841 A | | 5/1986 | Hunter | |
| 4,718,213 A | | 1/1988 | Butterfield | |
| 4,722,161 A | | 2/1988 | Young | |
| 4,742,662 A | | 5/1988 | Smith | |
| 4,790,112 A | | 12/1988 | Wang | |
| 4,838,002 A | | 6/1989 | Dajnko et al. | |
| 4,848,054 A | | 7/1989 | Blitzer et al. | |
| 4,883,513 A | | 11/1989 | Monson et al. | |
| 4,893,444 A | | 1/1990 | Ollinger et al. | |

(List continued on next page.)

FOREIGN PATENT DOCUMENTS

| | | |
|---|---|---|
| FR | 2520411 | 7/1983 |
| GB | 2128222 A | 4/1984 |
| GB | 2142356 A | 1/1985 |
| GB | 2173227 A | 10/1986 |
| GB | 2262948 A | 7/1993 |
| WO | WO 93/17197 | 9/1993 |

OTHER PUBLICATIONS

AQM Service Inc. (Building and Maintenance Products), T–Bar Grid Cover, www.aqmservice.com/tbar.htm, Dec. 2000.

STIX Basic T–Bar covers with the Easy Clip, Dec. 2000.

*Primary Examiner*—Jeanette Chapman

(57) ABSTRACT

The invention provides a ceiling-grid system including a main-runner and a cross-tee. The main-runner has a main-runner tee-portion including at least one opening having a frustoconical portion and a second portion. The cross-tee has a cross-tee tee-portion and a cross-tee support shoulder. The cross-tee tee-portion includes an end and a projection extending from the end. The cross-tee support shoulder is coupled to the cross-tee tee-portion and the projection is insertable into the frustoconical portion and slidable into the second portion.

13 Claims, 6 Drawing Sheets

U.S. PATENT DOCUMENTS

| | | | | | |
|---|---|---|---|---|---|
| 4,937,994 | A | | 7/1990 | Ritter | |
| 5,044,138 | A | | 9/1991 | Zaccardelli et al. | |
| 5,207,035 | A | | 5/1993 | Fowler | |
| 5,259,162 | A | | 11/1993 | Nicholas | |
| 5,313,750 | A | | 5/1994 | Frecska et al. | |
| 5,325,647 | A | | 7/1994 | Forry et al. | |
| 5,347,783 | A | | 9/1994 | Frecska et al. | |
| 5,394,669 | A | | 3/1995 | Hallett et al. | |
| 5,396,748 | A | | 3/1995 | Rogers | |
| 5,414,969 | A | | 5/1995 | Krejci et al. | |
| 5,421,132 | A | | 6/1995 | Bischel et al. | |
| 5,428,930 | A | | 7/1995 | Bagley et al. | |
| 5,495,697 | A | | 3/1996 | Bischel et al. | |
| 5,535,566 | A | | 7/1996 | Wilson et al. | |
| 5,609,007 | A | | 3/1997 | Eichner | |
| 5,611,185 | A | | 3/1997 | Wilz | |
| 5,687,525 | A | * | 11/1997 | Koski et al. | 52/506.07 |
| 5,761,868 | A | * | 6/1998 | LaLonde et al. | 52/506.07 |
| 5,836,127 | A | | 11/1998 | Clark et al. | |
| 5,893,249 | A | * | 4/1999 | Peterson et al. | 52/506.07 |
| 6,047,511 | A | | 4/2000 | Lehane | |
| 6,205,732 | B1 | | 3/2001 | Rebman | |
| 6,305,137 | B1 | | 10/2001 | Rebman | |
| 6,324,806 | B1 | | 12/2001 | Rebman | |
| 6,438,921 | B1 | * | 8/2002 | Moore | 52/655.1 |
| 6,477,815 | B2 | * | 11/2002 | Paul et al. | 52/506.06 |
| 6,526,716 | B2 | * | 3/2003 | Paul | 52/506.06 |

* cited by examiner

CEILING GRID SYSTEM AND METHOD OF ASSEMBLING THE SAME

FIELD OF THE INVENTION

The invention relates to a ceiling grid system, and more particularly, to a plastic-ceiling-grid system and a method of assembling the same.

BACKGROUND OF THE INVENTION

Ceiling grid systems for supporting tile panels, such as acoustical ceiling tiles, are used extensively in both new and remodeled building and room structures. Grid systems typically consist of main-runners and cross-tees, having lateral supporting shoulders, that are arranged perpendicular to each other to form a rectangular pattern. After the grid is installed, the tile panels are placed onto the supporting shoulders of the runners and cross-tees. Such a grid system offers many advantages such as increasing a room's energy efficiency, improving a room's acoustics, enhancing the aesthetic value of a room, lowering a ceiling, and allowing for the installation of electrical fixtures, pipes and duct work.

Ceiling grid systems are relatively inexpensive to install as compared to a plaster ceiling. As a consequence, there is a continuing need to improve on the design and integrity of grid systems, particularly in light of the fact that many such systems are installed in commercial buildings requiring years of service, or installed by the do-it-yourself home owner.

In particular, there is a need to simplify installation of ceiling grid systems. There is also a need to facilitate installation of ceiling grid systems in a low-clearance-spaced-relation to a ceiling. In many instances where a room may have a low ceiling, the ceiling grid system may need to be suspended in a closely-spaced relation to the ceiling. This limits the amount of working space above the grid in which to install the ceiling grid system, and more particularly, ceiling tiles. Many current ceiling grid systems are difficult or impossible to install in such low clearance spaces because the cross-tees are typically connected to the main-runners by tilting the rear end of the cross-tee upward and the front end of the cross-tee downward. This installation is extremely difficult in low clearance spaces because the ceiling prevents the rear end of the cross-tee from being tilted upward. In addition, installation is difficult because there is little room to install the ceiling tiles above the ceiling grid system because of the low clearance.

There is a further need to extend the life of the ceiling grid system. After a period of use, a suspended ceiling grid system (e.g. one made from metal) may begin to degrade. More particularly, metal components that have been painted may start to rust, flake, chip, or even become damaged by denting. Further, the color of a painted metal grid system as seen by a room's occupant may become discolored or faded over time. For example, in a food processing plant, flaking paint from a suspended ceiling grid system may be a safety and/or health hazard. In general, such degraded ceiling grid systems are not aesthetically pleasing. Typically, such a degraded ceiling grid system has to be either repainted or removed/replaced with a new ceiling grid system, both at a high cost in labor and materials. Repainting may also be a temporary fix in that it is likely the paint will begin to flake or peel again. In addition, chemicals emitted in certain factories and plants may also be harmful to the ceiling grid system. As a result, these grid systems need to be replaced

SUMMARY OF THE INVENTION

In one aspect, the invention provides a ceiling-grid system. The ceiling-grid system includes a main-runner having a main-runner tee-portion. The main-runner tee-portion includes at least one opening having a frustoconical portion and a second portion. The ceiling-grid system also includes a cross-tee. The cross-tee has a cross-tee support shoulder, a cross-tee tee-portion having an end, and a projection extending from the end of the cross-tee tee-portion. The cross-tee support shoulder is coupled to the cross-tee tee-portion. The projection of the cross-tee is insertable into the frustoconical portion and slidable into the second portion.

In another aspect, the invention provides another ceiling-grid system. The ceiling-grid system includes a main-runner and a cross-tee. The cross-tee includes a tee-portion and a support shoulder. The tee-portion is coupled to the support shoulder and lies in a plane substantially perpendicular to the support shoulder. The tee-portion also includes an end and a projection extending from the end in substantially the same plane as the tee-portion. The support shoulder includes a length, a width and a center axis that extends the length of the support shoulder and through a center of the width. The tee-portion is offset from the center axis.

In a further aspect, the invention provides a method of assembling a suspended-ceiling-grid system to a ceiling. The method includes supporting a main-runner to the ceiling. The main-runner includes a main-runner tee-portion having a first side, a second side and at least one opening defined in the main-runner tee-portion. The opening includes a first portion and a second portion. The first portion has an upper portion narrowing to a lower portion and the second portion has a bottom surface. The method also includes providing a first cross-tee having a cross-tee tee-portion and a cross-tee support shoulder coupled to the cross-tee tee-portion. The cross-tee tee-portion has an end and a first projection extending from the end. The first projection is inserted through the first portion of the opening from the first side of the main-runner tee-portion, and the first projection slides into the second portion of the opening. A second cross-tee having a second cross-tee tee-portion and a second cross-tee support shoulder coupled to the second cross-tee tee-portion is also provided. The second cross-tee tee-portion has an end and a second projection extending from the end. The second projection is inserted through the first portion of the opening from the second side of the main-runner tee-portion. The method also includes sliding the second projection into the second portion of the opening beside the first projection such that the first and second projections engage each other and compressionally fit within the second portion of the opening.

Figure 1:
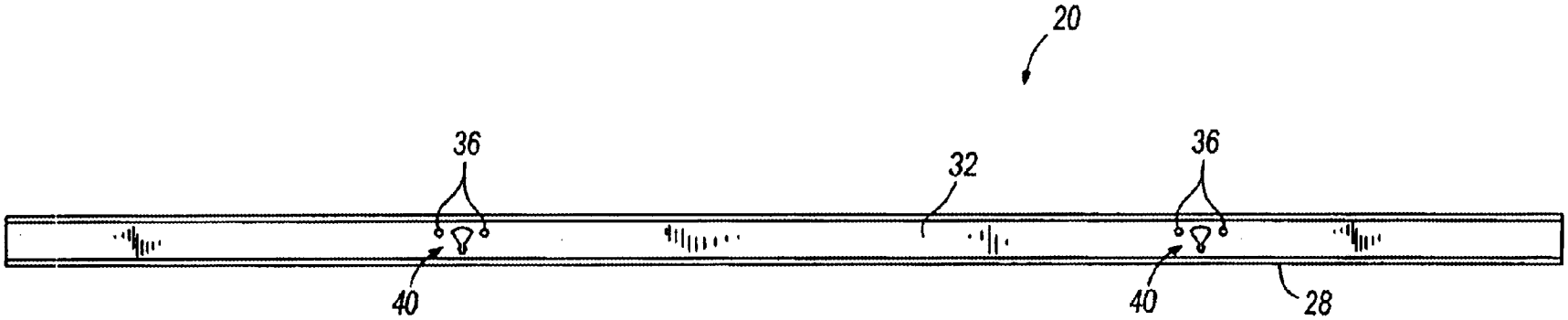
FIG. 1 is a side view of a main-runner embodying a portion of the present invention.

Before one embodiment of the invention is explained in detail, it is to be understood that the invention is not limited in its application to the details of the construction and arrangements of the components set forth in the following description or illustrated in the drawings. The invention is capable of other embodiments and of being practiced or carried out in various ways. Also, it is understood that the phraseology and terminology used herein is for the purpose of description and should not be regarded as limiting. The use of "including," "comprising" and "having" and variations thereof herein is meant to encompass the items listed thereafter and equivalents thereof as well as additional items.

DETAILED DESCRIPTION OF THE PRESENT INVENTION

As used herein, the term "low-clearance-spaced relation" means that the ceiling grid system is suspended closely below the ceiling. More specifically, the term "low-clearance-spaced relation" means a distance of between about 2 to 6 inches, and more particularly about 2 to 3 inches, exists between the ceiling and the support shoulders of the main-runners and cross-tees.

As used herein, the term "coupled" means that one element is integrally formed to another element or that one element is either connected directly or indirectly to another element or is in mechanical communication with another element. Examples include indirectly or directly attaching one element to another (e.g., via welding, bolting, gluing, mating, frictionally engaging, compressing together or against, snap-fitting, etc.), integrally attaching elements with one another, integrally fabricating elements from the same element or body, acting elements upon one another (e.g., via camming, pushing, or other interaction) and imparting motion from one element directly or through one or more other elements to another element.

Figure 2:
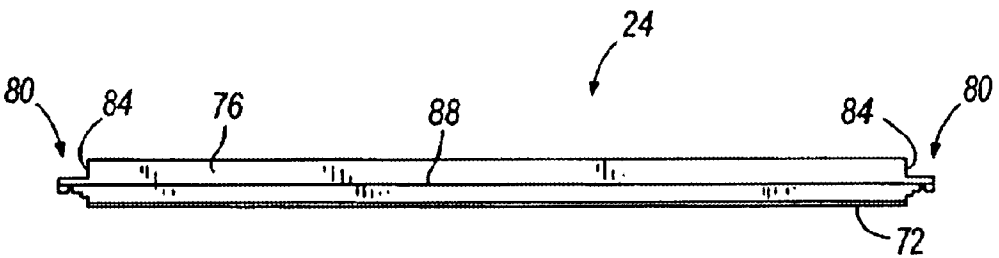
FIG. 2 is a side view of a cross-tee embodying a portion of the present invention.

Referring to FIGS. 1 and 2, a main-runner 20 and a cross-tee 24 are illustrated, respectively, and embody the present invention. A ceiling-grid system can be formed by connecting or assembling a plurality of main-runners 20 and a plurality of cross-tees 24 in substantially perpendicular arrangement to each other. More particularly, the main-runners 20 are suspended from a ceiling (not shown) and the cross-tees 24 are locked into the main-runners 20 as described in more detail below to form the ceiling grid system. The resulting ceiling grid system can support ceiling tiles (not shown) in a low-clearance-spaced relation to the ceiling. In a preferred embodiment, the main-runner 20 and the cross-tee 24 are made entirely from plastic. Examples of plastics include, but are not limited to, PVC, ABS, acrylics and polycarbonates as those terms are known in the art. Preferably, the system is manufactured using plastic extrusion methods, injection molding methods and pull-trusion, each of which is well-known in the art. In another embodiment, the main-runner 20 and cross-tee 24 may be made of other materials such as metal and different woods.

Figure 3:
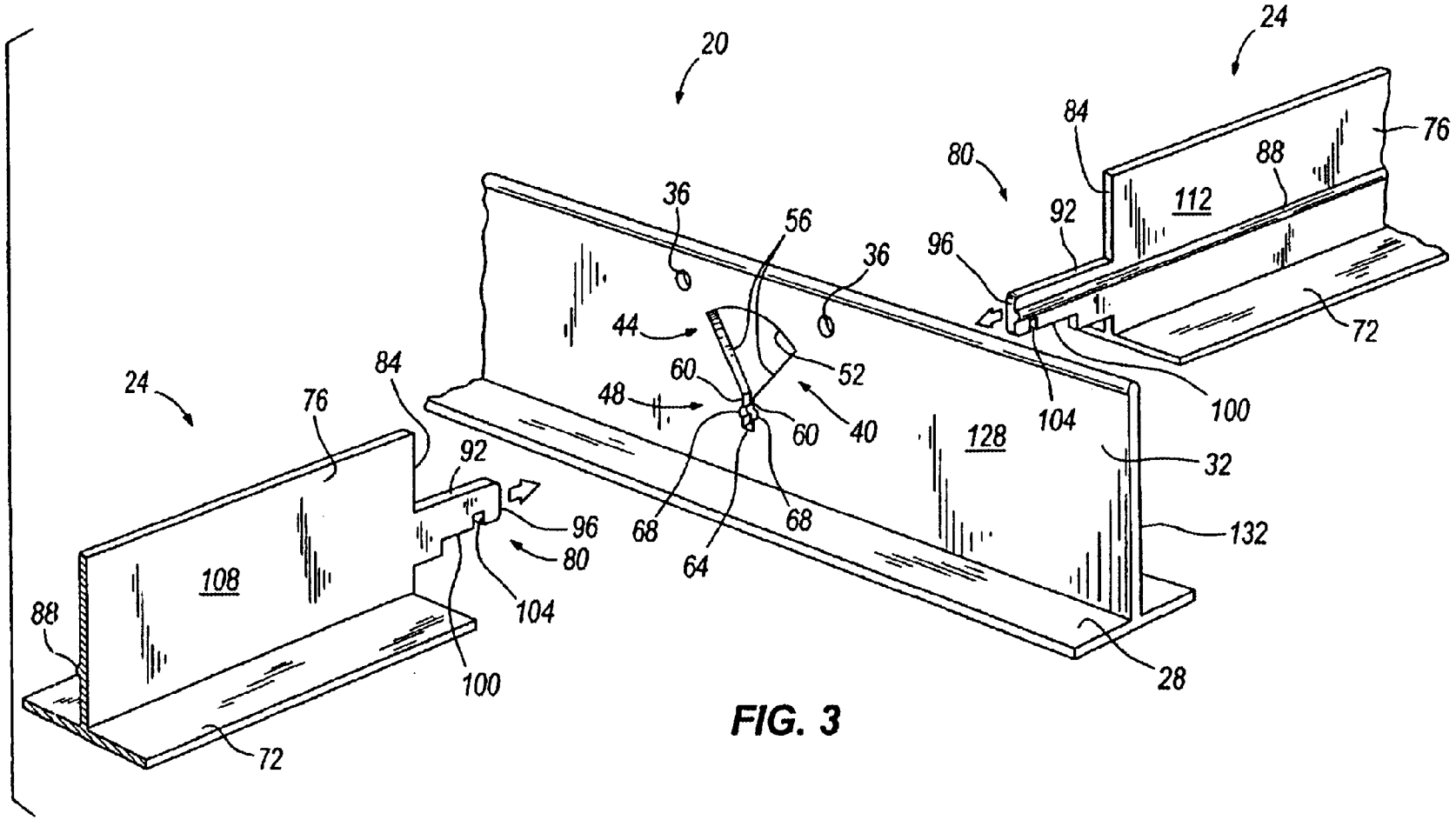
FIG. 3 is a partial perspective view of the main-runner and two cross-tees as illustrated in FIGS. 1 and 2, respectively.

Referring now to FIGS. 1 and 3, the main-runner 20 includes a main-runner support shoulder 28 and a main-runner tee-portion 32 coupled substantially perpendicularly to the main-runner support shoulder 28. Preferably, the main-runner 20 is between 8 to 12 feet in length, although 8-foot main-runners are highly preferred. The length of the main-runner 20 may also fall outside this range, and will be dictated largely by the size of the ceiling. The main-runner support shoulder 28 may partially support ceiling tiles to prevent the ceiling tiles from falling through the ceiling grid system when the main-runners and cross-tees are fully installed. Preferably, the width of the main-runner support shoulder is about 5/16 inch or 15/16 inch.

The main-runner tee-portion 32 has a plurality of hanging apertures defined therein to facilitate hanging the main-runner 20 from the ceiling (not shown). Preferably, the hanging apertures 36 are spaced evenly apart. The main-runner 20 hangs from the ceiling in a suspended position. Manners by which the main-runners 20 are hung are well known to those skilled in the art. Among many others, examples include hanging the main-runner 20 from the ceiling using string, wire, plastic, hanger wire, a tie rod or a wood stud.

The main-runner tee-portion 32 also includes openings 40 defined therein into which projections of the cross-tees are inserted. In one embodiment, when the main-runner 20 is about eight-feet in length, the openings are evenly spaced apart beginning twelve inches in from one end, and then spaced twenty-four inches apart thereafter such that four openings exist in the main runner 20. As shown in FIG. 1, a hanging aperture 36 is spaced about ½ to 1 inch on each side of and above each opening 40. FIG. 1 only shows two openings 40, although the preferred amount of openings is four. The openings have a first portion 44 and a second portion 48. In one preferred embodiment, the first portion 44 includes an upper curved surface 52 and two sides 56. The two sides 56 angle toward each other as they approach the second portion 48 to facilitate assembly of the main-runner 20 and the cross-tees 24 (discussed in greater detail below). Preferably, the two sides may angle toward one another in a range of 0–180° the first portion may have an upper portion narrowing to a lower portion. In another embodiment, the opening may be frustoconical. The first portion 44 may take any shape, however, that facilitates the assembly of the main-runner 20 to the cross-tee 24 under low-clearance-spaced relation. For example, the first portion 44 may be circular or oval. Preferably, the second portion 48 is rectangular and includes two sides 60 and a bottom surface 64. A recess 68 may be defined in one or both sides 60 of the second portion 48.

Figure 4:
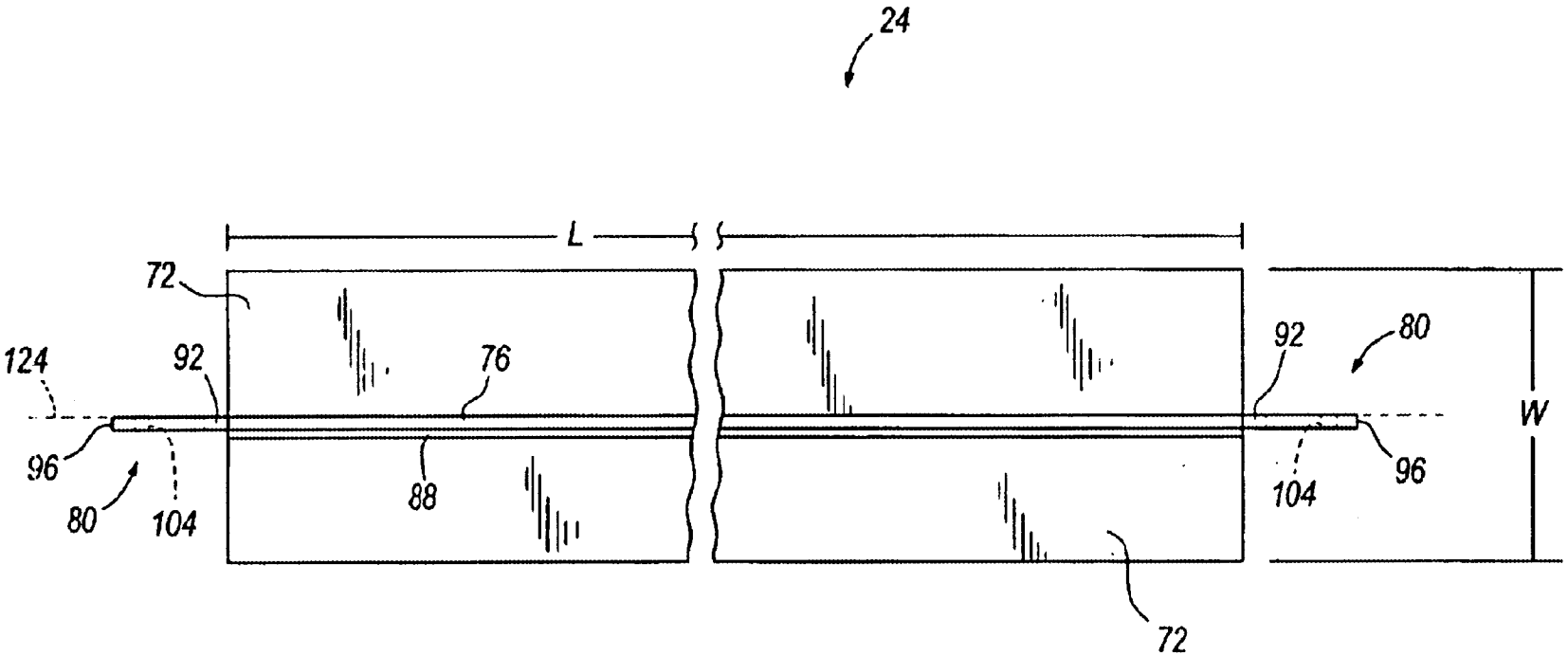
FIG. 4 is a broken top view of the cross-tee illustrated in FIG. 2.

Referring to FIGS. 2 and 3, the cross-tee 24 includes a cross-tee support shoulder 72 and a cross-tee tee-portion 76 coupled substantially perpendicular to the cross-tee support shoulder 72. Preferably, the cross-tee is about two feet in length in order to enable a two-by-two foot or two-by-four foot grid system. Alternatively, the cross-tee may also be four feet in order to enable a four-by-foot system as well. Again, the length of the cross-tee may vary in order to fit a variety of ceiling grid systems and ceilings. The cross-tee support shoulder 72 may partially support ceiling tiles in order to prevent the ceiling tiles from falling through the ceiling-grid system. As shown in FIG. 4, the cross-tee support shoulder 72 of the cross-tee 24 has a length L, a width W and a center axis 124 or imaginary center line that extends through the center of the width W. The center axis 124 divides the cross-tee support shoulder 72 into two equal halves. The cross-tee tee-portion 76 is offset from the center axis 124 and divides the cross-tee support shoulder 72 into two unequal portions having varying widths. In other words, in a preferred embodiment the cross-tee tee-portion 76 is not coupled to the cross-tee support shoulder 72 at the center axis 124, but is rather offset. Preferably, the tee-portion 76 is offset from the center axis about one-half to one cross tee's 76 width from the center axis as shown in FIG. 4. The width W of the cross-tee support shoulders is preferably about 5/16 or 15/16 of an inch.

The cross-tee tee-portion 76 lies in a plane and has two ends 84, at least one of which includes a projection 80 extending therefrom. Preferably, the cross-tee tee-portion 76 has two projections 80 extending outwardly and away from each end 84 within the same plane as the cross-tee tee-portion 76. The projections 80 include a top edge 92, a side edge 96 and a bottom edge 100. The top and bottom edges 92, 100 are substantially parallel to the cross-tee support shoulder 72 and the side edge 96 is substantially perpendicular to the cross-tee support shoulder 72. A notch 104 is defined in the bottom edge 100 and is rectangular in the preferred embodiment. The notch 104 may, however, be other shapes and still be within the scope of the present invention, including but not limited to arcuate, triangular, and trapezoidal. The notch 104 engages the bottom surface 64 of the second portion 48 of the opening 40 to lock the main-runner 20 and cross-tee in place.

The cross-tee tee-portion 76 also includes a first side 108 and a second side 112. In the preferred embodiment, a tab 88 is positioned on either the first side 108 or the second side 112. In one embodiment, the tab 88 extends along the projections 80 and the entire length of one of these sides 108, 112 of the cross-tee tee-portion 76. It is important for the tab 88 to extend along the projections 80 and the entire length of the cross-tee tee-portion 76 because it makes the cross-tee 24 easier and cheaper to manufacture. Particularly, the cross-tee 24 can be extruded easier and more cost-effectively if the tab 88 is a single-continuous extension rather than several pieces spaced apart from each other. In another embodiment, however, the tab may extend along only a portion of one or both of the projections. The tab 88 may also be positioned on both the first and second sides 108, 112 or may extend along only a portion of the length of the cross-tee tee-portion 76 and the projections 80. In other words, the tab 88 need not extend the full length of the cross-tee tee-portion 76 and the projections 80. In the preferred embodiment, the tab 88 is arcuate, however, the tab 88 may be any shape and still be within the scope of the present invention, including but not limited to being square, rectangular, triangular and trapezoidal.

Now that the structural elements of the present invention have been described, the assembly of the main-runners 20 and cross-tees 24 will now be described. Referring to FIG. 3, the main-runner 20 and two cross-tees 24 are illustrated. The main-runner 20 is hung from a ceiling, possibly in low-spaced-relation to the ceiling (not shown), using the hanging apertures 36. The main-runner 20 is hung such that the main-runner tee-portion 32 is substantially perpendicular to the ceiling and the main-runner support shoulder 28 is substantially parallel with the ceiling. After the main-runner 20 is hung from the ceiling, two cross-tees 24 per opening 40 may be mounted to the main-runner 20.

Figure 5:
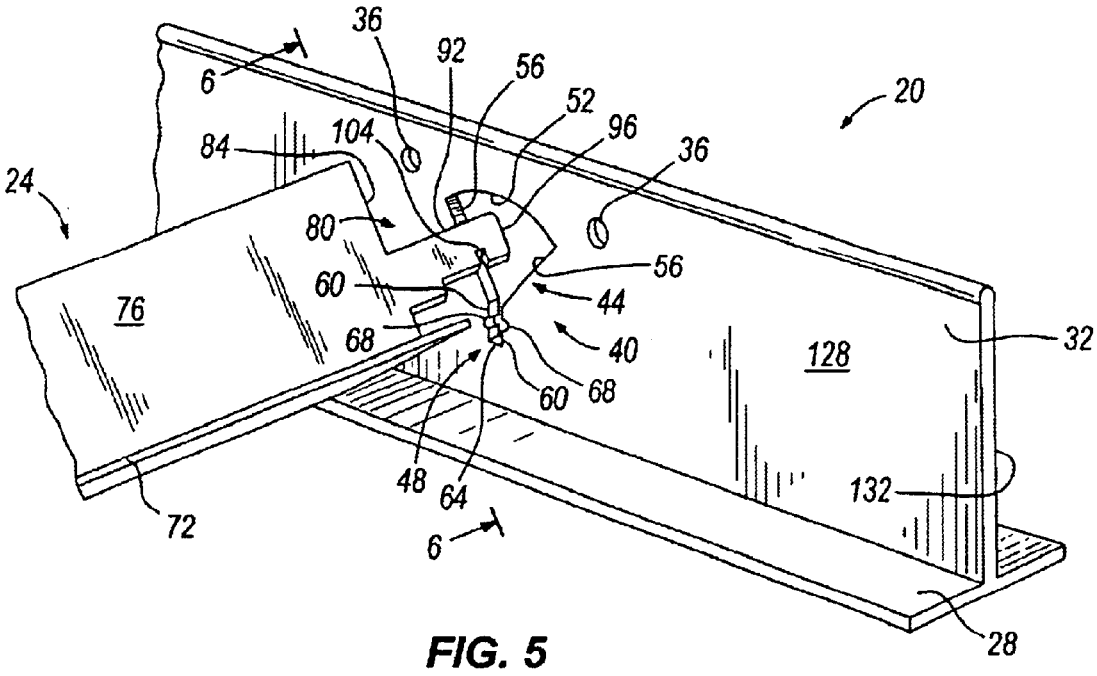
FIG. 5 is a partial perspective view of the cross-tee being rotated and inserted into the main-runner.
Figure 6:
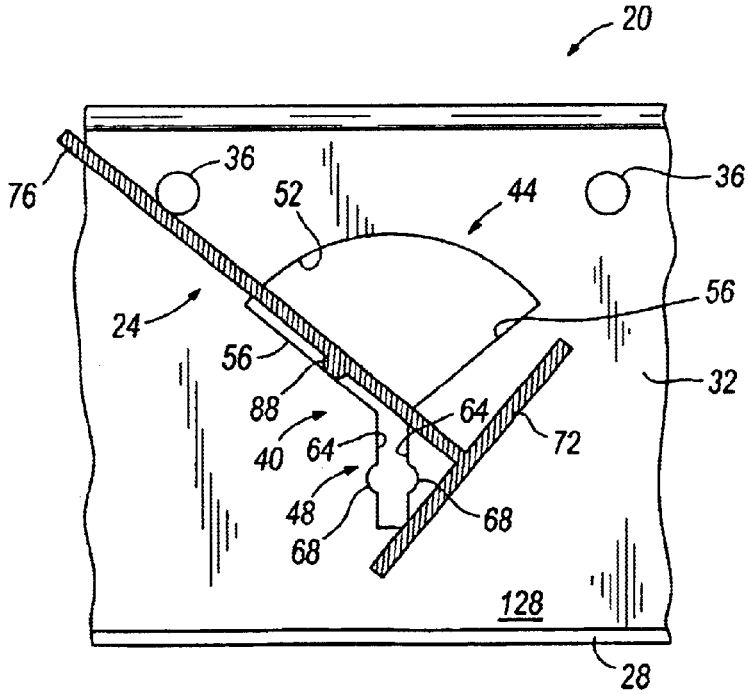
FIG. 6 is a sectional view along line 6–6 in FIG. 5.

Referring to FIGS. 5 and 6, a main-runner 20 and a cross-tee 24 are illustrated. When hanging the main-runner 20 in low-spaced-relation to the ceiling, sufficient working area above the ceiling grid system may not be provided for an installer to assemble the main-runners 20 and cross-tees 24. Therefore, the present invention facilitates assembly of the main-runners 20 and cross-tees 24 in low-clearance space by allowing an installer to rotate the cross-tee 24 as shown in FIGS. 5 and 6. In the preferred embodiment and the illustrated figures, the cross-tee 24 is rotated in order to take advantage of the shape of the first portion 44 of the opening 40. Rotating the cross-tee 24 allows the projection to be inserted into the first portion 44 without tilting the cross-tee 24 dramatically upwardly or downwardly as required in prior art ceiling grid systems. The opening 44 allows for rotation in either direction of 0 to over 70 degrees. The cross-tee 24 need not be rotated before initial introduction into the opening 44, however, it may be useful to rotate the cross-tee after insertion in order to facilitate installation of a ceiling tile. This greatly facilitates the installation of a ceiling tile as the cross-tee 24 can be rotated as best shown in FIG. 6. In other words, a portion 73 of the cross-tee supporting shoulder 72 can be rotated in a downwardly direction due to the shape of the opening 44 so that the ceiling tile can be placed on top of the portion 73. Subsequently, the cross-tee 24 is rotated and snapped back into place. As shown in FIGS. 5 and 6, the projection 80 is inserted into the first portion 44 from a first side 128 of the main-runner 20. The cross-tee 24 may be rotated such that the tab 88 engages one of the two sides 56 of the first portion 44 (as shown in FIG. 6), however, the cross-tee 24 does not have to be rotated to that extreme to facilitate assembly of the main-runner 20 and cross-tee 24. This arrangement allows for installation of both the ceiling grid system and the ceiling tiles under low-clearance conditions. In other systems, it is difficult to navigate the ceiling tiles above the ceiling grid system once the system is in place.

Figure 7:
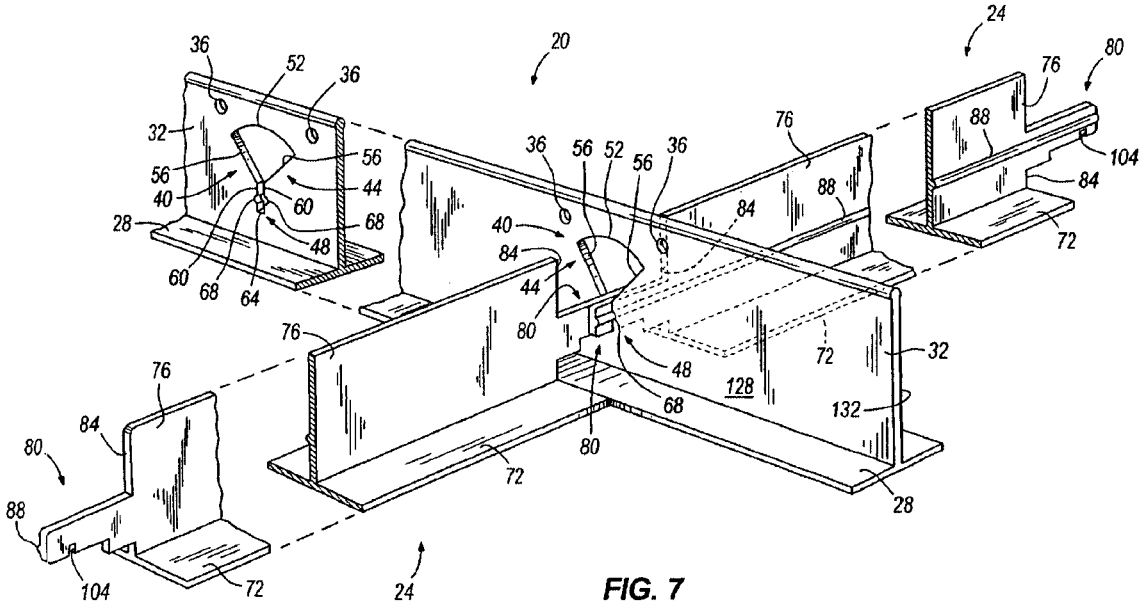
FIG. 7 is a broken perspective view of the two cross-tees connected to the main-runner.
Figure 8:
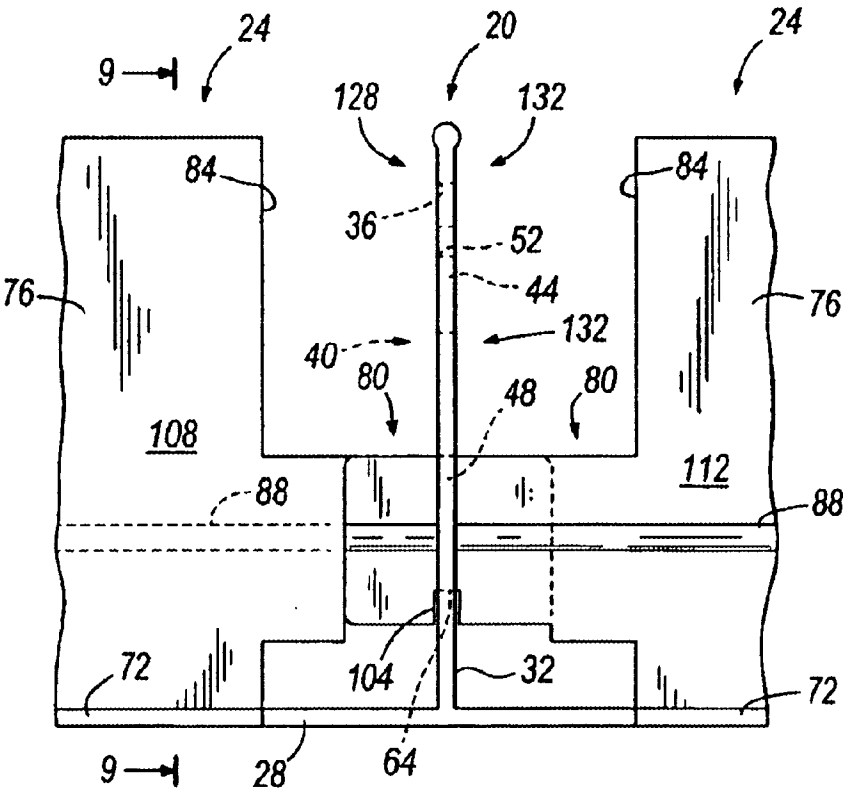
FIG. 8 is a partial side view of the two cross-tees and main-runner illustrated in FIG. 7.
Figure 9:
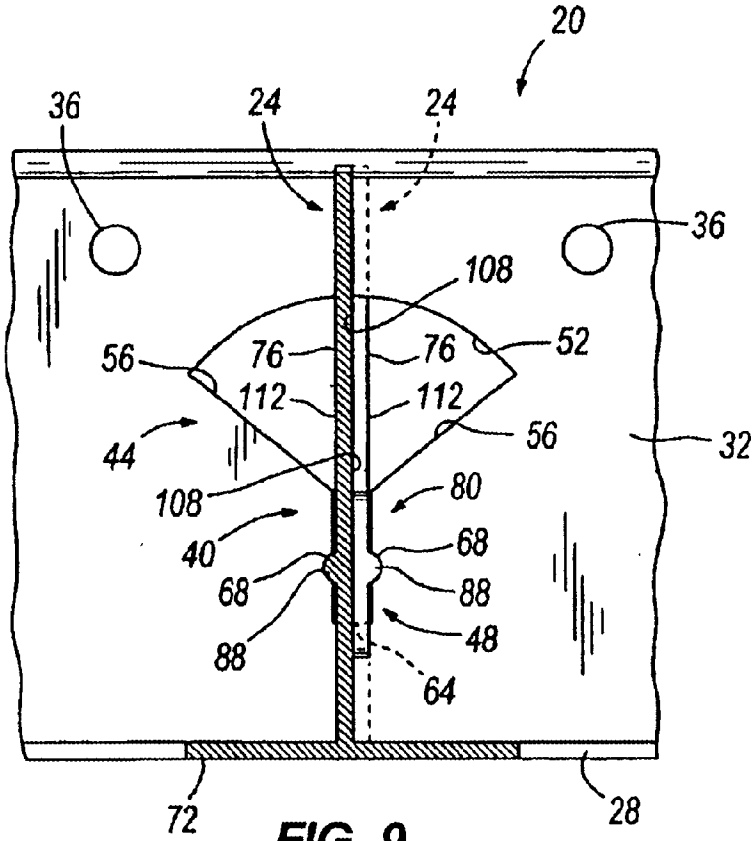
FIG. 9 is a sectional view along line 9—9 in FIG. 8.

Referring to FIGS. 7–9, the main-runner 20 and the two cross-tees 24 are illustrated. After the projection 80 has been inserted into the first portion 44, the cross-tee 24 is slid downwardly such that the projection 80 slides downwardly into the second portion 48. The angled sides of the first portion 44 naturally funnel the projection 80 toward the second portion 48 when sliding the projection 80 downwardly. As the projection 80 slides into the second portion 48, the projection 80 and cross-tee 24 move into a substantially vertical orientation. Upon sliding the projection 80 completely into the second portion 48, the notch 104 engages the bottom surface 64 of the second portion 48 to secure the cross-tee 24 in place. The tab 88 may also engage one of the recesses 68. At this point, the cross-tee 24 is substantially perpendicular to the main-runner 20, and the main-runner support shoulder 28 and the cross-tee support shoulder 72 lie in substantially the same plane.

A second cross-tee 24 having identical structure to the first cross-tee 24 is also provided as shown in FIGS. 7–9. Of course, variations of the cross-tee as described above may also be used, i.e., it is not necessary to have identical cross-tees. Fabricating identical cross-tees, however, is highly cost-effective and preferred for manufacturing reasons. An identical second cross-tee 24 is flipped 180° from the orientation of the first cross-tee 24 and its projection is inserted into the first portion 44 of the opening 40 from a second side 132 of the main-runner 20. The second cross-tee 24 is installed in flipped, opposite arrangement such that the tab 88 of the second cross-tee 24 extends in the opposite direction from the tab 88 from the first cross-tee 24. This enables each tab 88 to engage each recess 68 upon full installation as shown in FIG. 9 and further described below. In addition, because the cross-tee tee-portions 76 of the first and second cross-tees 24 are offset, flipping the second cross-tee 24 allows the two cross-tees 24 to line up as shown in FIG. 9. Thus, although the second cross-tee 24 may be structurally identical to the first cross-tee, the second cross-tee 24 is flipped as shown in FIG. 7 in order for the respective projections (lying in the same plane as the cross-tees) to be inserted into the opening without being bent or distorted. In other words, the projections remain in their same planes, each of which is substantially the same of the planes of its cross-tee tee-portions 76. Other than flipping the second cross-tee 24, the installation of the second cross-tee 24 into the opening 40 of the main-runner 20 is substantially the same as the first cross-tee 24.

In other words, the second projection 80 is introduced into the first portion 44 and then slid downwardly into the second portion 48 until the second projection's notch engages the bottom surface of the second portion 48. The width of the second portion 48 is equal to or slightly narrower than the combined width of two projections 80. Therefore, when the projection 80 from the second cross-tee 24 is introduced into the first portion 44 of the opening 40 from the second side 132, and slid downwardly into the second portion 48 in which the projection 80 of the first cross-tee 24 is already positioned, a compressional force is applied on the projections 80 from the two sides 60 of the second portion 48 and the projections 80 compressionally fit within the second portion 48. The projection 80 of the second cross-tee 24 is slid downwardly until its tab 88 engages the other recess 68 of the second portion 48 of the opening 40 until the projections 80 snap or pop into place. The two cross-tees 24 are locked into place when each tab 88 engages each recess 68. By compressional fitting the projections 80 within the second portion 48, the projections 80 are less likely to slide out of the second portion 48. The tab-recess engagement is not a necessary feature, but does act to further secure the cross-tee 24 to the main-runner 20. The combination of compressionally fitting the projections 80 within the second portion 48 and engaging each tab into its respective recess 68 greatly decreases the likeliness of the projections 80 sliding out of the second portion 48. Movement of the cross-tees 24 with respect to the main-runner 20 is limited vertically by the compressional fit between the projections 80 and the second portion 48 and horizontally by the two sides 60 of the second portion 48 and the engagement between the notches 104 and bottom surface 64.

As described above in the assembly of the cross-tees 24 and the main-runner 20, the second cross-tee 24 is flipped 180° from the orientation of the first cross-tee 24 and inserted into the first portion 44 from the second side 132 of the main-runner 20. By flipping the second cross-tee 24 180°, the offset cross-tee tee-portions 76 of the first and second cross-tees 24 do not lie in the same plane (illustrated best in FIG. 9), however, the cross-tee support shoulders 72 of the first and second cross-tees 24 are within each others profile (illustrated best in FIG. 9). It is important in practice that the support shoulders of cross-tees remain in each other's profile for aesthetic purposes. Cross-tee support shoulders should lie within each other's profile and line up in the ceiling grid system. This offset arrangement is an improvement over other systems in which the tee-portions of cross-tees are not offset but rather extend from a center axis, thereby forcing locking features of the cross-tees to be bent or otherwise offset from the plane in which the tee-portions lie so that the projections avoid each other when the cross-tees are assembled to the main-runners. Again, in the preferred embodiment, the cross-tee tee-portions 76 are offset from the center axis 124, which allows the projections 80 to avoid each other when assembled to the main-runner 20, while still allowing the cross-tees 24 to line up as shown in FIG. 9. Preferably each projection lies in substantially the same plane before and after installation as the plane of its cross-tee tee-portion 76 which further reduces manufacturing costs because the pieces are easier to extrude.

Although particular constructions of the present invention have been shown and described, other alternative constructions will be apparent to those skilled in the art and are within the intended scope of the present invention. Thus, the present invention is to be limited only by the following claims.

I claim:

1. A ceiling-grid system comprising:

a main-runner; and a cross-tee including a tee-portion and a support shoulder, the tee-portion being coupled to the support shoulder; the tee-portion lying in a plane substantially perpendicular to the support shoulder and including an end and a projection extending firm the end in substantially the same plane as the tee-portion, and the support shoulder including a length, a width and a center axis extending the length of the support shoulder and through a center of the width, the tee-portion being offset from the center axis of the support shoulder.

2. The system as claimed in claim 1, wherein the tee-portion further comprises a tab running substantially parallel to the support shoulder along at least a portion of the projection.

3. The system as claimed in claim 2, wherein the tee-portion further comprises a first side and a second side, the tab naming along at least a portion of one of the first and second sides.

4. The system as claimed in claim 3, wherein the tab runs along the entire side.

5. The system as claimed in claim 1, wherein the main-runner further comprises a main-runner tee-portion coupled to a main-runner support shoulder, the main runner tee-portion having at least one opening having a first portion and a rectangular portion.

6. The system as claimed in claim 5, wherein the projection includes a top edge, a side edge and a bottom edge having a notch defined therein, the projection being insertable through the first portion and slidable into the rectangular portion, such that the notch engages a bottom surface of the rectangular portion when the projection is slid into the rectangular portion.

7. The system as claimed in claim 5, further comprising a second cross-tee including a second tee-portion and a second support shoulder, the second tee-portion being coupled to the second support shoulder, and the second tee-portion lying in a second plane and including two sides, an end, and a second projection extending from the end in substantially the same plane as the second tee-portion, and wherein the second support shoulder includes a second length, a second width and a second axis extending the second length thereof and through a center of the second width, the second tee-portion being offset from the second axis.

8. The system as claimed in claim 1, wherein the ceiling-grid system is made entirely from plastic.

9. The system as claimed in claim 8, wherein the plastic comprises at least one of PVC, ABS, acrylic and polycarbonate.

10. The system as claimed in claim 7, wherein the first and second projections are insertable through the first portion and slidable into the rectangular portion such that the plane of the tee-portion and projection and the plane of the second tee-portion and second projection do not align, but the first and second support shoulders are in substantially the same profile.

11. The system as claimed in claim 7, wherein the projection is a first projection and has a first tab, and wherein the second projection has a second tab and the rectangular portion has two recesses, and wherein the first and second projections engage each other in the rectangular portion and the first tab and the second tab each engage one of the recesses when the two projections are inserted in the rectangular portion.

12. The system as claimed in claim 5, wherein the first portion has an upper and lower portion, and the upper portion is wider than the rectangular portion such that the projection can be rotatably inserted into the upper portion and slid into the rectangular portion.

13. The system as claimed in claim 5, wherein the rectangular portion of the opening is positioned downwardly from the first portion.

* * * * *